US005266970A

United States Patent [19]

Stephenson

[11] Patent Number: 5,266,970

[45] Date of Patent: Nov. 30, 1993

[54] HOT BAR FUSER

[75] Inventor: Stanley W. Stephenson, Spencerport, N.Y.

[73] Assignee: Eastman Kodak Company, Rochester, N.Y.

[21] Appl. No.: 896,013

[22] Filed: Aug. 5, 1992

[51] Int. Cl.[5] ..... B41J 2/32

[52] U.S. Cl. ..... 346/76 PH; 219/216

[58] Field of Search ..... 346/76 PH; 400/120, 400/240, 240.3, 240.4; 219/216; 355/282, 285, 289, 290, 295; 430/97, 99

[56] References Cited

U.S. PATENT DOCUMENTS

| | | | |
|---|---|---|---|
| 4,666,320 | 5/1987 | Kobayashi et al. | 400/241.1 |
| 4,738,555 | 4/1988 | Nagashima | 346/76 PH |
| 4,912,486 | 3/1990 | Yumino | 346/76 PH |
| 4,973,987 | 11/1990 | Koshizuka et al. | 346/76 PH |
| 4,990,931 | 2/1991 | Sato et al. | 346/1.1 |
| 5,027,160 | 6/1991 | Okada et al. | 355/282 |

FOREIGN PATENT DOCUMENTS

| | | | |
|---|---|---|---|
| 0148778 | 9/1983 | Japan | 400/240.3 |

*Primary Examiner*—Benjamin R. Fuller
*Assistant Examiner*—Huan Tran
*Attorney, Agent, or Firm*—Milton S. Sales

[57] ABSTRACT

A thermal printer produces an image on a front surface of a thermal dye receiver. The printer contains a web of material having a thermally activated transferable coating and a roller for supporting the receiver and orienting the receiver with the front surface facing the web. A solid bar is positioned opposite the receiver and web, and urges the web and receiver against the roller. The solid bar is heated to transfer the coating from the web to the front surface of the receiver.

8 Claims, 2 Drawing Sheets

HOT BAR FUSER

TECHNICAL FIELD OF THE INVENTION

The present invention relates generally to thermal printing, and, more particularly, to apparatus for fusing a thermal print.

BACKGROUND OF THE INVENTION

In typical thermal printers, a resistive element thermal head is used to transfer dye from a dye bearing donor web to a dye receiving member. The head, dye donor and receiver are brought into contact, and the thermal head elements are selectively energized to transfer variable quantities of thermal dye from the donor to the receiver. The receiver is advanced past the thermal head in a controlled manner so that sequential lines of pixels are generated until a complete image is formed on the dye receiver. The transferred dye remains close to the surface of the receiver and is susceptible to mechanical, chemical and thermal aging and deterioration. Increased printing speed is always desirable, but as a result, the dye image becomes even more susceptible to damage. In addition, mechanical deformation occurs in the print as speed increases and the quantity of dye increases. Accordingly, it will be appreciated that it would be highly desirable to repair the damage and provide greater stability of the resulting image.

There are several ways to improve the image stability after printing. In some printing processes, the dyes are reheated by rollers that apply a controlled amount of heat to the image bearing surface. As a result of the heating process, the thermal dyes migrate a greater distance into the dye receiver surface and image stability is improved. While this process tends to improve dye stability, it does not repair mechanical damage to the print surface.

U.S. Pat. No. 4,666,320 which issued May 19, 1987 to Kobayashi et al. discloses that repeating the thermal printing process using a non-inked web in the printing station improves dye stability and improves mechanical defects in the surface, and that a protective coating can be applied in the clear area to provide a surface coating over the inked area. U.S. Pat. No. 5,027,160 which issued Jun. 25, 1991 to Okada et al. discloses an image fixing apparatus that includes a heater and an endless film through which a toner image on a recording material is heated by heat produced by the heater. Unfortunately, it is difficult to maintain the constant temperatures that are required for high quality fusing. Accordingly, it will be appreciated that it would be highly desirable to have a fusing apparatus that provides even, constant temperature heat for fusing.

SUMMARY OF INVENTION

The present invention is directed to overcoming one or more of the problems set forth above. Briefly summarized, according to one aspect of the present invention, an apparatus treats a thermal dye receiver having an image on a front surface. The apparatus comprises a web of material having a thermally activated transferable coating and a roller for supporting the receiver and orienting the receiver with the front surface facing the web. A solid bar is positioned opposite the receiver and web, and is movable between a first position at which the bar is spaced from the web and a second position at which the bar is in contact with the web urging the web and receiver against the roller. The transferable coating contacts the front surface at the second position. The solid bar is heated to a temperature sufficient to cause the transferable coating to transfer from the web to the front surface of the receiver.

The present invention repairs mechanical damage caused by higher printing speeds and higher dye densities. It provides even heat at a constant temperature.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
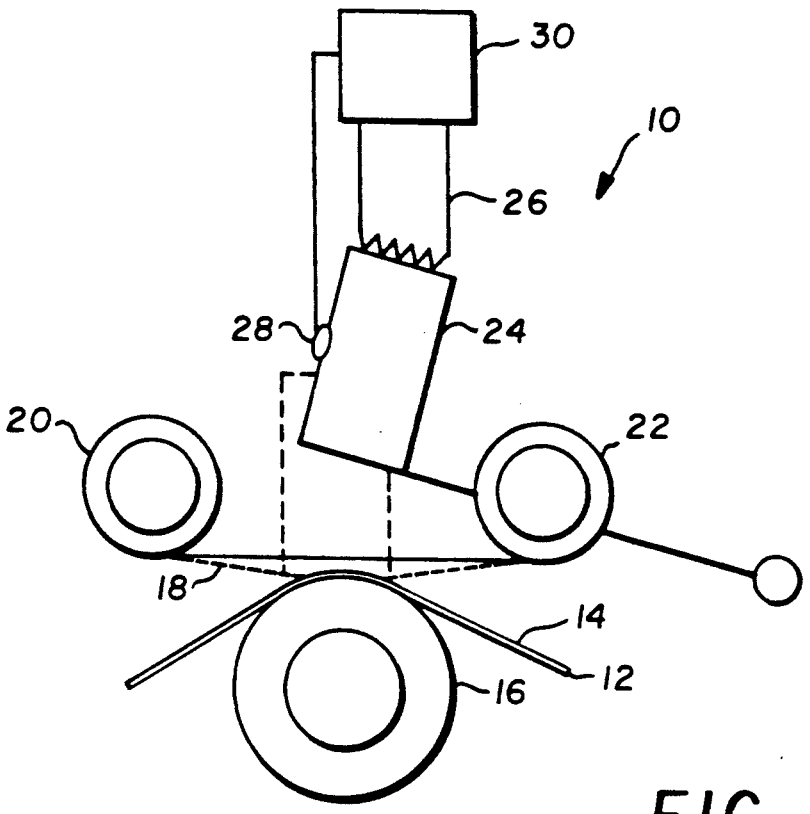
FIG. 1 is a diagrammatic view of a preferred embodiment of a thermal printer with a hot bar fuser.

Referring to FIG. 1, there is illustrated an apparatus, such as a thermal printer 10, for example, for treating a thermal dye receiver 12 having an image on a front surface 14 thereof. For the fusing operation, the receiver 12 is urged through the apparatus by a platen roller 16. The roller 16 is preferably coated with a heat resistant material such as silicone rubber. A web 18 of material has a thermally activated transferable coating on one side and is supported on a supply roller 20 on one end and a take-up roller 22 on the other end. The web 18 traverses a path through the apparatus that brings it near the platen roller 16 so that the coated side faces the image side 14 of the receiver 12 in the vicinity of the platen roller 16.

A solid bar 24 is positioned opposite the receiver 12 and web 18 with the web 18 between the receiver 12 and web 18. The bar 24 is movable between a first position at which the bar 24 is spaced from the web 18, and a second position at which the bar 24 is in contact with the web 18 urging the web 18 and receiver 12 against the platen roller 16. At the second position, the transferable coating of the web 18 contacts the front surface 14 of the receiver 12.

Figure 4:
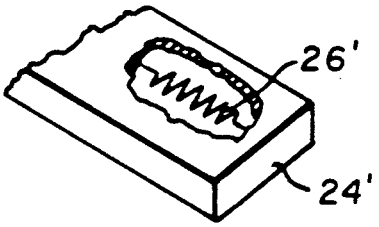
FIG. 4 is a perspective view with a cut away portion illustrating another preferred embodiment with internal heating.

Still referring to FIG. 1, the solid bar 24 is heated by heater 26 to a temperature sufficient to cause the transferable coating to transfer from the web 18 to the front surface 14 of the receiver 12. The heater 26 may be in abutting contact with the solid bar 24 (FIG. 1), or may be contained within the solid bar 24' (FIG. 4). By having a solid bar 24, the heat is uniformly distributed and the bar 24 retains heat to maintain a constant temperature for fusing. The bar 24 may be constructed of a solid block of aluminum, or, when the heater is internal, may be a hollow block filled with a thermal conductor of similar heat conductivity to the aluminum.

A temperature sensor 28 is preferably positioned on the solid bar 24 to sense the temperature of the solid bar 24. A temperature control 30 is responsive to the sensed temperature to maintain the solid bar 24 at a preselected temperature.

Figure 2:
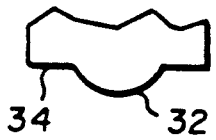
FIG. 2 is cross-sectional view of the hot bar of FIG. 1.

Referring to FIG. 2, the solid 24 bar contains a radius projection 32 on a contact surface 34 to increase contact pressure between the solid bar 24 and the web 18, receiver 12, and platen roller 16. The increased pressure is sufficient to cause the front surface 14 of the receiver 12 to flow to thereby correct for mechanical damage.

Figure 3:
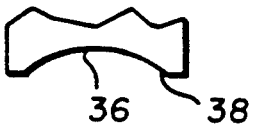
FIG. 3 is cross-sectional view similar to FIG. 1, but illustrating another preferred embodiment.

Referring to FIG. 3, the solid bar 24' contains a concave surface 36 on a contact surface 38. The concave surface 36 cups the web 18, receiver 12 and platen roller 16 to thereby increase the length of receiver 12 heated by the solid bar 24' at one time.

Figure 5:
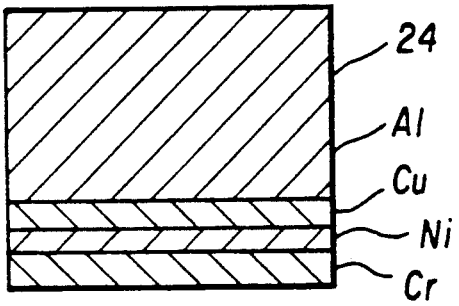
FIG. 5 is a diagrammatic sectional view of the hot bar illustrating the coatings.

Referring to FIG. 5, the solid bar 24 is preferably aluminum with a coating of copper plated over the aluminum, and with nickel plated over the copper. Finally, chromium is plated over the nickel. Alternatively, the solid bar 24 may be coated with TEFLON in the contact area to improve slip between the heating surface and the thermal media elements.

Operation of the present invention is believed to be apparent from the foregoing description, but a few words will be added for emphasis. The platen roller provides the drive to urge the receiver through the fusing apparatus. The heated bar is contained in a low conductivity enclosure that is pivotally mounted to be brought into contact with the receiver on the platen roller. The fusing material is disposed between two spools so that the web is interposed between the hot bar and the receiver. The web is normally off the platen and receiver, but when the hot bar is brought down, the fusing web is brought down into contact with the receiver. To prevent heat from the hot bar from damaging the web when not performing a fusing operation, one or more protective covers can be disposed to cover the opening in the hot bar enclosure when the hot bar is in the nonfusing position.

The fusing bar is of substantial size to provide a reservoir of heat that can be continuously discharged into the fusing process without a significant drop in temperature. A solid bar was constructed with a length of over eleven inches to fuse a full page print. A heating element was positioned on the side of the bar farthest away from the fusing area. The heat was distributed uniformly through the bar as it passed from the heated side to the fusing side of the bar. One or more temperature sensors provide a temperature estimate of the bar. These estimates are fed back to the electronic controller that regulates heat delivery to the heating element.

It can now be appreciated that the heating contact area can be modified to improve the fusing process. A radius projection can be used to raise the pressure in the nip and cause the surface material to flow to correct for mechanical damage to the surface of the receiver. The time the print dwells in the nip can be increased by a concave surface on the hot bar that cups the receiver over the platen surface. The length of the receiver in contact with the hot bar is increased by cupping, and therefore the contact time for a given receiver feed speed is increased.

While the invention has been described with particular reference to the preferred embodiments, it will be understood by those skilled in the art that various changes may be made and equivalents may be substituted for elements of the preferred embodiment without departing from invention. In addition, many modifications may be made to adapt a particular situation and material to a teaching of the invention without departing from the essential teachings of the present invention.

It can also be appreciated that there has been described a coating for the contact area of the hot bar. A hard surface can reduce damage from dirt particles that pass through the nip. An aluminum hot bar is coated with a copper overstrike then plated with nickel and then with chromium to form a hard surface on the contact area. Slip characteristics between the contact area and fusing web can be improved with a coating applied to the contact area, such as TEFLON based polymer.

As is evident from the foregoing description, certain aspects of the invention are not limited to the particular details of the examples illustrated, and it is therefore contemplated that other modifications and applications will occur to those skilled the art. It is accordingly intended that the claims shall cover all such modifications and applications as do not depart from the true spirit and scope of the invention.

What is claimed is:

1. An apparatus for treating a thermal dye receiver having an image on a front surface, comprising:

a web of material having a thermally activated transferable coating;

a roller for supporting said receiver and orienting said receiver with said front surface facing said web;

a solid bar positioned opposite said receiver and web, said bar being movable from between a first position at which said bar is spaced from said web and a second position at which said bar is in contact with said web urging said web and receiver against said roller, said transferable coating contacting said front surface at the second position, said solid bar defines a concave surface that cups said web receiver and roller to thereby increase a length of receiver heated by said solid bar at one time;

means for heating said solid bar to a temperature sufficient to cause said transferable coating to transfer from said web to said front surface of said receiver;

means for sensing a temperature of said solid bar; and means, responsive to said sensing means, for maintaining said solid bar at a preselected temperature.

2. An apparatus, as set forth in claim 1, wherein said solid bar is coated in contact area to improve slip between said solid bar and said thermal media elements.

3. An apparatus, as set forth in claim 2, wherein said coating is TEFLON based polymer.

4. An apparatus, as set forth in claim 2, wherein said solid bar is aluminum and said coating is copper plated over said aluminum with nickel over the copper and chromium over the nickel.

5. A thermal printer, comprising:

means for producing an image on a front surface of a thermal dye receiver;

a web of material having a thermally activated transferable coating;

a roller for supporting said receiver and orienting said receiver with said front surface facing said web;

a solid bar positioned opposite said receiver and web, said bar being movable between a first position at which said bar is spaced from said web and a second position at which said bar is in contact with said web urging said web and receiver against said roller, said transferable coating contacting said front surface at the second position, said solid bar defines a concave surface that cups said web, receiver and roller to thereby increase a length of receiver heated by said solid bar at one time;

means for heating said solid bar to a temperature sufficient to cause said transferable coating to transfer from said web to said front surface of said receiver;

means, located on said solid bar, for sensing a temperature of said solid bar; and means, responsive to said sensing means, for maintaining said solid bar at a preselected temperature.

6. An apparatus, as set forth in claim 5, wherein said solid bar contains a radius projection on a contact surface to increase contact pressure between said solid bar and said web, receiver and roller.

7. An apparatus, as set forth in claim 5, wherein said solid bar is coated in contact area to improve slip between said solid bar and said thermal media elements.

8. An apparatus, as set forth in claim 7, wherein said solid bar is aluminum and said coating is copper plated over said aluminum with nickel over the copper and chromium over the nickel.

* * * * *